US009168202B2

(12) United States Patent
Clouser et al.

(10) Patent No.: US 9,168,202 B2
(45) Date of Patent: Oct. 27, 2015

(54) DEVICE AND METHOD FOR DOCKING A VIAL WITH A CONTAINER

(75) Inventors: Doug Clouser, Galloway, OH (US); Gary L. Sharpe, Naples, FL (US)

(73) Assignee: Gary L. Sharpe, Naples, FL (US)

( * ) Notice: Subject to any disclaimer, the term of this patent is extended or adjusted under 35 U.S.C. 154(b) by 646 days.

(21) Appl. No.: 13/356,176

(22) Filed: Jan. 23, 2012

(65) Prior Publication Data

US 2012/0186201 A1 Jul. 26, 2012

Related U.S. Application Data

(60) Provisional application No. 61/436,461, filed on Jan. 26, 2011.

(51) Int. Cl.

| | |
|---|---|
| ***B65B 7/16*** | (2006.01) |
| ***A61J 1/20*** | (2006.01) |
| *A61J 1/10* | (2006.01) |

(52) U.S. Cl.

CPC ..... *A61J 1/20* (2013.01); *A61J 1/10* (2013.01); *A61J 1/2003* (2013.01); *A61J 1/2089* (2013.01)

(58) Field of Classification Search

CPC ..... A61J 3/002; A61J 3/00; A61M 31/00; B65B 7/16

USPC ..... 53/489, 485, 305, 328, 285, 287, 319, 53/324, 342, 363, 364, 390; 604/414

See application file for complete search history.

(56) References Cited

U.S. PATENT DOCUMENTS 807,080 A * 12/1905 Keenan ..... B67B 1/005 141/105
1,657,782 A * 1/1928 Berg ..... 141/330
1,801,381 A * 4/1931 Walmsley ..... 53/310
1,981,565 A * 11/1934 Namur ..... 221/238
1,990,301 A * 2/1935 Pietro ..... 53/201
2,080,393 A * 5/1937 Moore ..... 53/324
2,088,010 A * 7/1937 Petersen ..... 53/305
2,366,524 A * 1/1945 Harder ..... 53/305
2,647,674 A * 8/1953 Bausano ..... 53/322
2,878,632 A * 3/1959 Foresman, Jr. ..... 53/330
3,169,665 A * 2/1965 Colley ..... 222/5
3,245,586 A * 4/1966 Haggitt ..... 222/88
3,494,506 A * 2/1970 Fujimoto ..... 222/5
3,715,865 A * 2/1973 Davis ..... 53/319
3,803,800 A * 4/1974 Tavernier ..... B67B 1/04 53/264
4,068,449 A * 1/1978 Harper ..... 53/319
4,599,123 A * 7/1986 Christensson ..... 156/69
5,037,390 A * 8/1991 Raines et al. ..... 604/83
5,185,985 A * 2/1993 Vetter et al. ..... 53/299
5,934,511 A * 8/1999 Ausmus ..... 222/87
6,070,761 A * 6/2000 Bloom et al. ..... 222/81
6,527,758 B2 * 3/2003 Ko ..... 604/403

(Continued)

*Primary Examiner* — Gloria R Weeks

(74) *Attorney, Agent, or Firm* — Standley Law Group LLP

(57) ABSTRACT

A device and method for docking a vial with a container is disclosed. A cap may be used to establish fluid communication between the vial and a container. The cap may be positioned within a first aperture in the device which is positioned below a second aperture which is sized to accept the vial. The second aperture may contain a taper so that the vial may automatically center above the piercing aperture of the cap. A notch may be placed adjacent to the first aperture so that the vial and cap may be removed horizontally from the device. A cavity may be positioned below the first aperture to accept at least a portion of a container which may be in fluid communication with the cap.

18 Claims, 8 Drawing Sheets

(56) References Cited

U.S. PATENT DOCUMENTS

| | | | | |
|---|---|---|---|---|
| 6,571,534 | B2 * | 6/2003 | De Young et al. | 53/329.2 |
| 6,604,903 | B2 * | 8/2003 | Osborne et al. | 414/411 |
| 6,689,108 | B2 * | 2/2004 | Lavi et al. | 604/211 |
| 6,723,068 | B2 * | 4/2004 | Lavi et al. | 604/82 |
| 6,877,530 | B2 * | 4/2005 | Osborne et al. | 141/27 |
| 7,128,105 | B2 * | 10/2006 | Tribble et al. | 141/319 |
| 7,299,601 | B2 * | 11/2007 | Yoshida et al. | 53/264 |
| 7,520,108 | B2 * | 4/2009 | Kristiansson et al. | 53/426 |
| 7,856,860 | B1 * | 12/2010 | Collison | 72/80 |
| 7,900,658 | B2 * | 3/2011 | Osborne et al. | 141/2 |
| 7,985,216 | B2 * | 7/2011 | Daily et al. | 604/533 |
| 8,382,696 | B2 * | 2/2013 | Beiriger | A61M 1/342 604/518 |
| 8,425,487 | B2 * | 4/2013 | Beiriger et al. | 604/411 |
| 8,535,289 | B1 * | 9/2013 | Forbes | 604/408 |
| 8,562,584 | B2 * | 10/2013 | Beiriger et al. | 604/411 |
| 2003/0036725 | A1 * | 2/2003 | Lavi et al. | 604/91 |
| 2010/0084041 | A1 * | 4/2010 | Fehr et al. | 141/1 |
| 2011/0004144 | A1 * | 1/2011 | Beiriger et al. | 604/6.11 |
| 2011/0004145 | A1 * | 1/2011 | Beiriger et al. | 604/6.11 |
| 2011/0030316 | A1 * | 2/2011 | Blumenstock et al. | 53/319 |
| 2011/0030320 | A1 * | 2/2011 | Blumenstock et al. | 53/485 |
| 2013/0035658 | A1 * | 2/2013 | Haenggi et al. | 604/408 |
| 2013/0296807 | A1 * | 11/2013 | Lintern et al. | 604/272 |

* cited by examiner

DEVICE AND METHOD FOR DOCKING A VIAL WITH A CONTAINER

CROSS-REFERENCE TO RELATED APPLICATIONS

This application claims priority to U.S. application Ser. No. 61/436,461 filed on Jan. 26, 2011, which is herein incorporated by reference in its entirety.

TECHNICAL FIELD

Embodiments generally relate to a device and method for docking a vial with a container.

BACKGROUND OF THE ART

Many medical fluids are typically manufactured and shipped in vials, which may have tamper-resistant, measurement, durability, and security features built in. Prior to using the fluid in a medical procedure, the fluid may need to be transferred to a different container. Thus, in various medical applications it may be desirable to create fluid communication between a vial and some type of alternate container (sometimes fluid bags such as intravenous bags), often referred to as 'docking.'

SUMMARY OF THE EXEMPLARY EMBODIMENTS

An exemplary embodiment herein provides a device which can dock a vial with another container quickly, easily, and at low cost and low spatial footprint. The device preferably contains a cavity and optional notch which can accept at least a portion of the chosen container. A plate may be used to hold the vial overtop a cap or adapter, which may contain a piercing aperture for establishing fluid communication between the vial and the container. An exemplary plate may contain an aperture for holding the cap in place during the docking process as well as a notch for allowing the cap and at least a portion of the container to exit the device once the docking process has been completed.

In a preferred embodiment, a lever arm may be moved in a downward motion to cause a plunger to move in a corresponding downward motion. The plunger preferably contains a tapered collar which can accept and center the vial prior to pressing the vial into the cap. The cap may also have a tapered portion for accepting and centering the vial. An exemplary cap may also have a ledge which holds the cap securely in place atop the plate while the vial is being pressed down into the cap for docking.

The foregoing and other features and advantages of the present invention will be apparent from the following more detailed description of the particular embodiments, as illustrated in the accompanying drawings.

BRIEF DESCRIPTION OF THE DRAWINGS

A better understanding of an exemplary embodiment will be obtained from a reading of the following detailed description and the accompanying drawings wherein identical reference characters refer to identical parts and in which.

DETAILED DESCRIPTION

Figure 1:
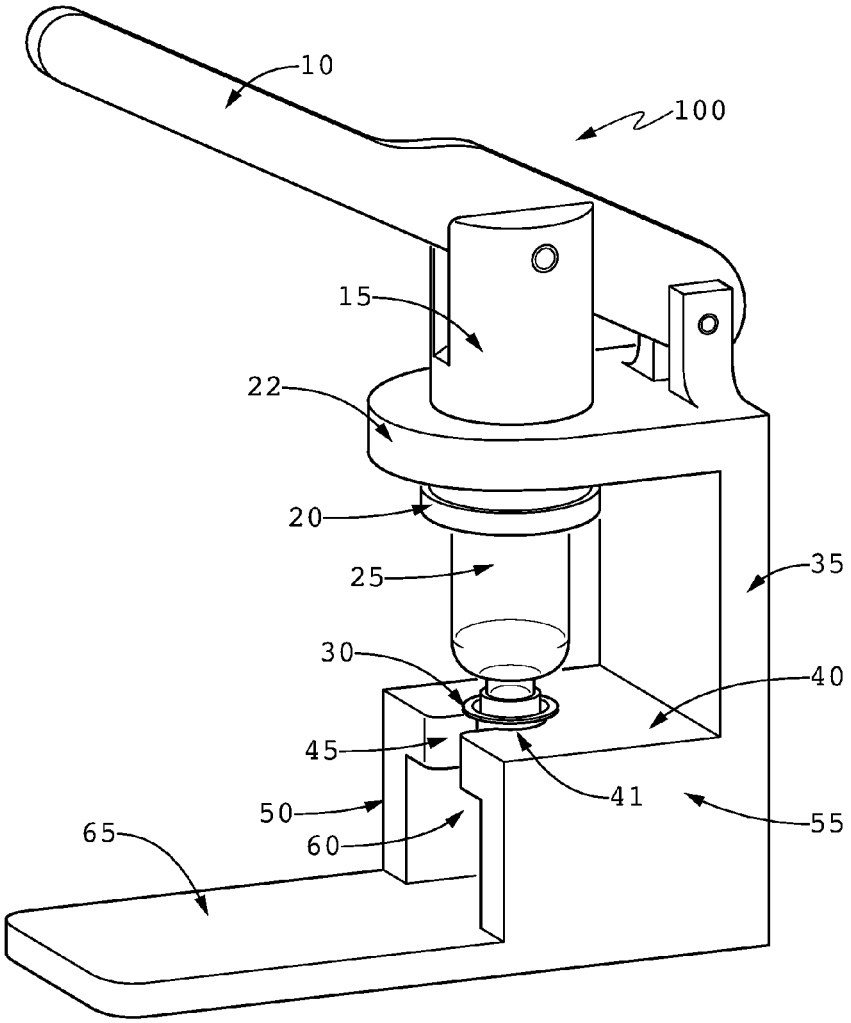
FIG. 1 is a perspective view of an exemplary embodiment of the device.

FIG. 1 is a perspective view of an exemplary embodiment of the device 100. A base 65 and vertical support 35 may provide a frame for the device 100. A plate 40 is preferably placed above the base 65 and rests upon a first base member 50 and second base member 55. The space defined by the area between the base 65, plate 40, vertical support 35, first base member 50, and second base member 55 may define a cavity 60, which can accept at least a portion of the chosen container to be docked with the vial 25. Preferably, the portion of the plate 40 which is opposite the vertical support 35 contains a cutout or notch 45 to allow at least a portion of the chosen container to pass through prior to and after the docking process.

In some embodiments, an adapter or cap 30 may be used to dock the vial 25 with the chosen container. If an adapter or cap 30 is used, the plate 40 would preferably contain an aperture 41 for accepting the cap 30. A lever arm 10 may be hingedly connected to the vertical support 35. The lever arm 10 may also be connected to a plunger 15 such that a downward motion of the lever arm 10 causes the plunger 15 to move downward as well. In the opposite direction, an upward motion on the lever arm 10 preferably causes an upward motion by the plunger 15. The bottom portion of the plunger 15 preferably contains a collar 20 which accepts the vial 25. A head support 22 may be connected to the vertical support 35 and may be used to guide the plunger 15 as it travels through its upward and downward motions.

Figure 2:
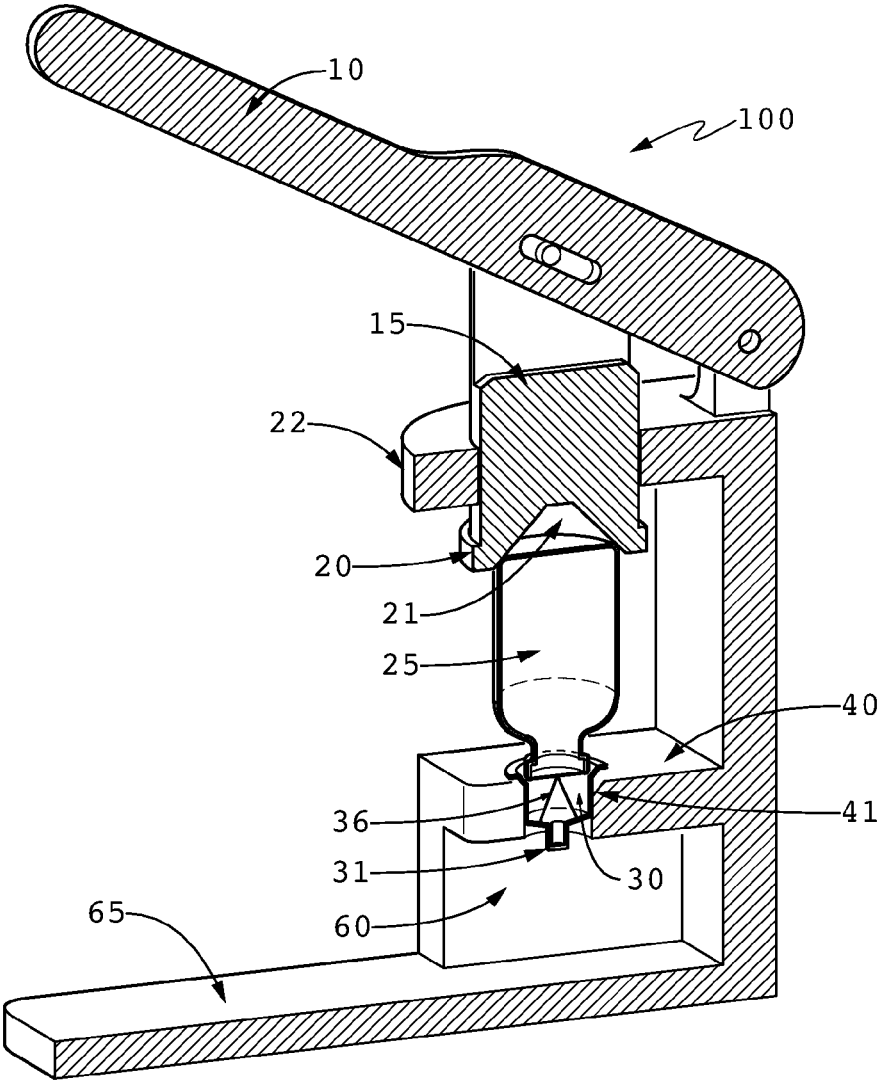
FIG. 2 is a perspective sectional view of the device shown in FIG. 1.

FIG. 2 is a perspective sectional view of the device 100. The collar 20 preferably contains a tapered aperture 21 for accepting and centering the vial 25 within the plunger 15. The aperture 41 within the plate 40 may accept the cap 30. Preferably, the aperture 41 is vertically aligned with the tapered aperture 21 in the collar 20 so that a downward motion of the lever arm 10 presses the vial 25 onto the cap 30. In some embodiments, the cap 30 may contain a piercing aperture 36 which may pierce a portion of the vial 25 when pressed into the cap 30. In this manner, the vial 25 may remain completely sealed until pierced by this portion of the cap 30. An exemplary cap 30 may also contain an attachment means 31 to establish fluid communication with the chosen container. In this particular embodiment, the attachment means 31 is a stem for accepting a tube or hose from the chosen container.

Figure 3A:
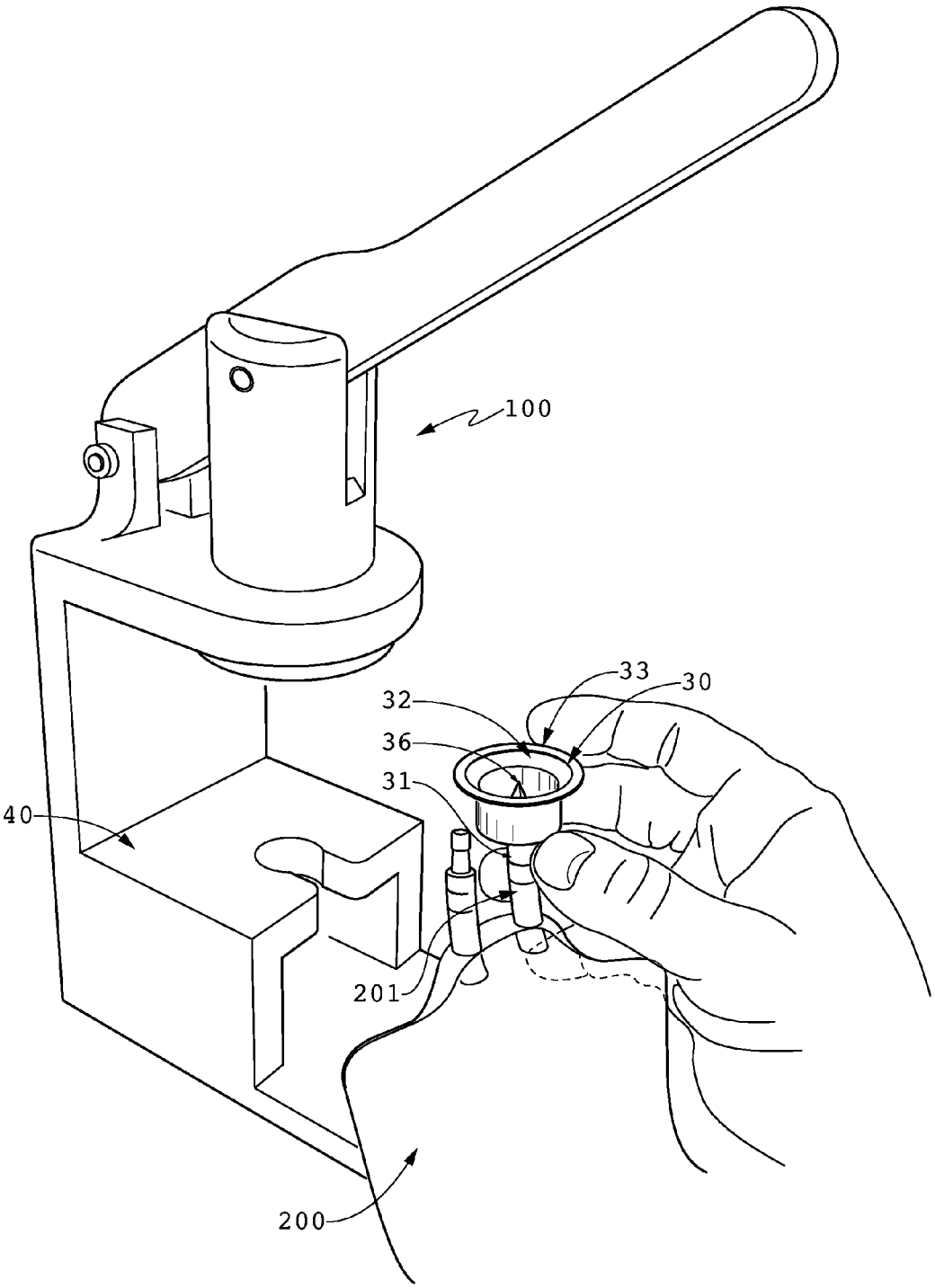
FIGS. 3A-3F are a series of illustrations showing an exemplary method for using the device of FIGS. 1 and 2 for docking a vial with a container.

FIG. 3A is an illustration of an initial step in an embodiment for using the device 100 to dock a vial 25 with a container 200. In this embodiment, the container 200 is a fluid bag, commonly known in the art as a 'mini-bag.' Of course, the device 100 can be used with any number of container styles, shapes, and sizes. Here, the container 200 contains a tube 201 which is adapted to attach to the attachment means 31 of the cap 30. In this particular embodiment, the tube 201 is sized to slide overtop a stem which is used as the attachment means 31. In this embodiment, the cap 30 contains a ledge 33 which is sized and adapted to rest atop the plate 40. Also shown in this figure is the piercing aperture 36 within the cap 30. In this embodiment, the cap 30 also contains a tapered portion 32 for accepting and centering the vial prior to docking.

Figure 3B:
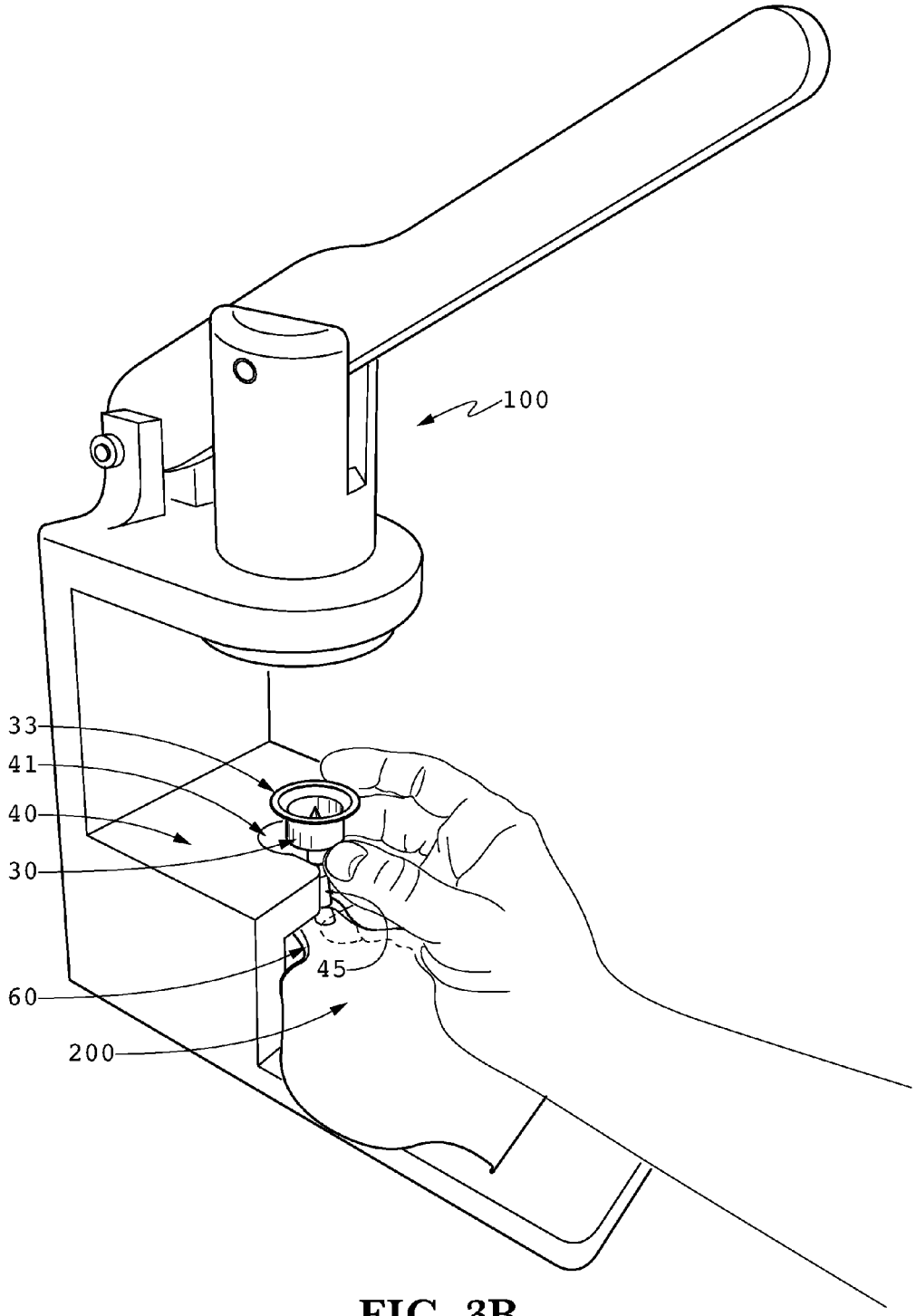

FIG. 3B is an illustration showing the container 200 and cap 30 being placed within the device 100. In this embodiment, a portion of the container 200 is permitted to pass through the notch 45 in the plate 40 so that the cap 30 can rest within the aperture 41. To prevent the cap 30 from moving vertically during the docking process, the ledge 33 of the cap 30 should preferably rest on the top surface of the plate 40. The cavity 60 may also contain at least a portion of the container 200 during this embodiment of the docking process.

Figure 3C:
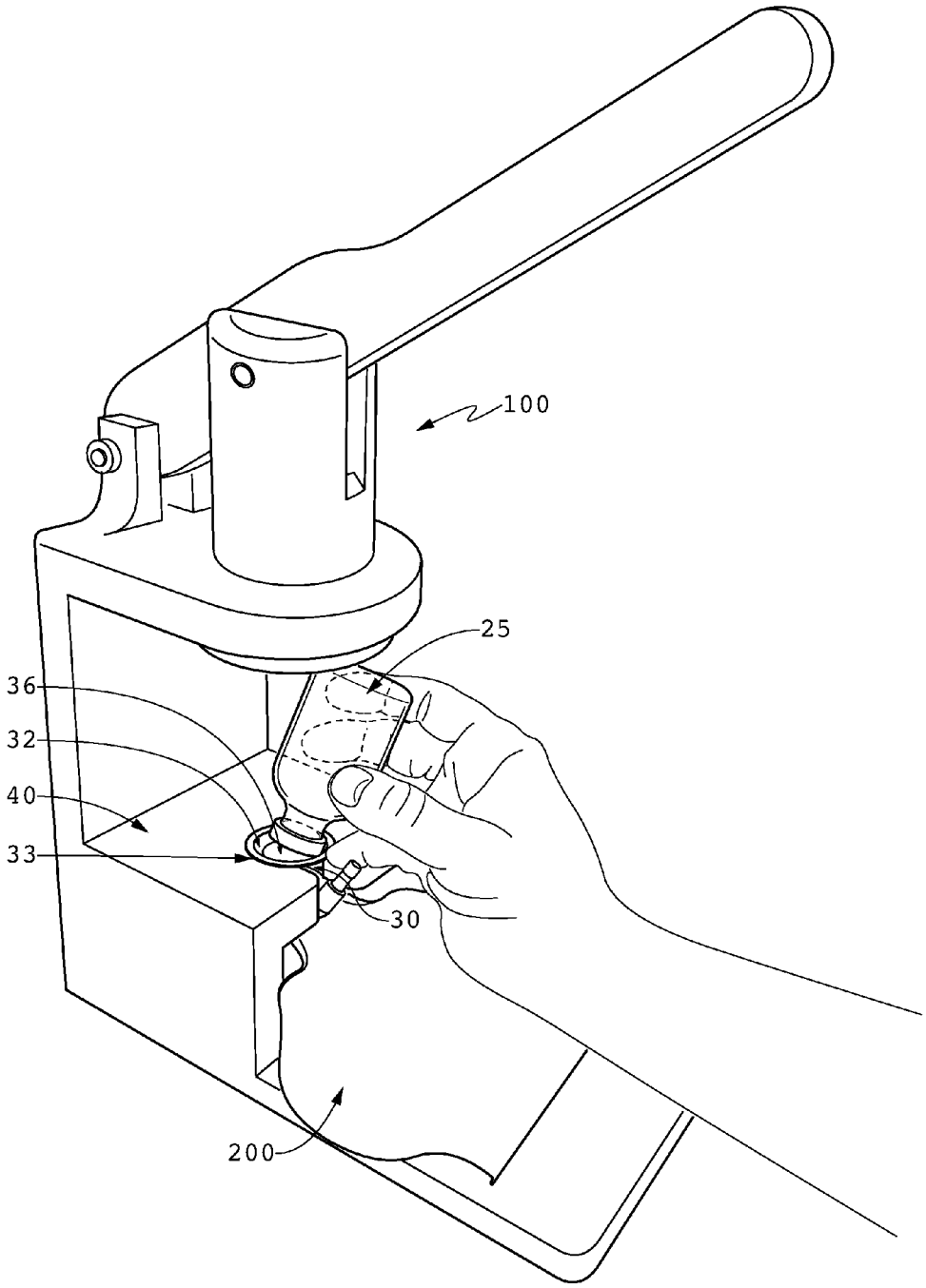
Figure 3D:
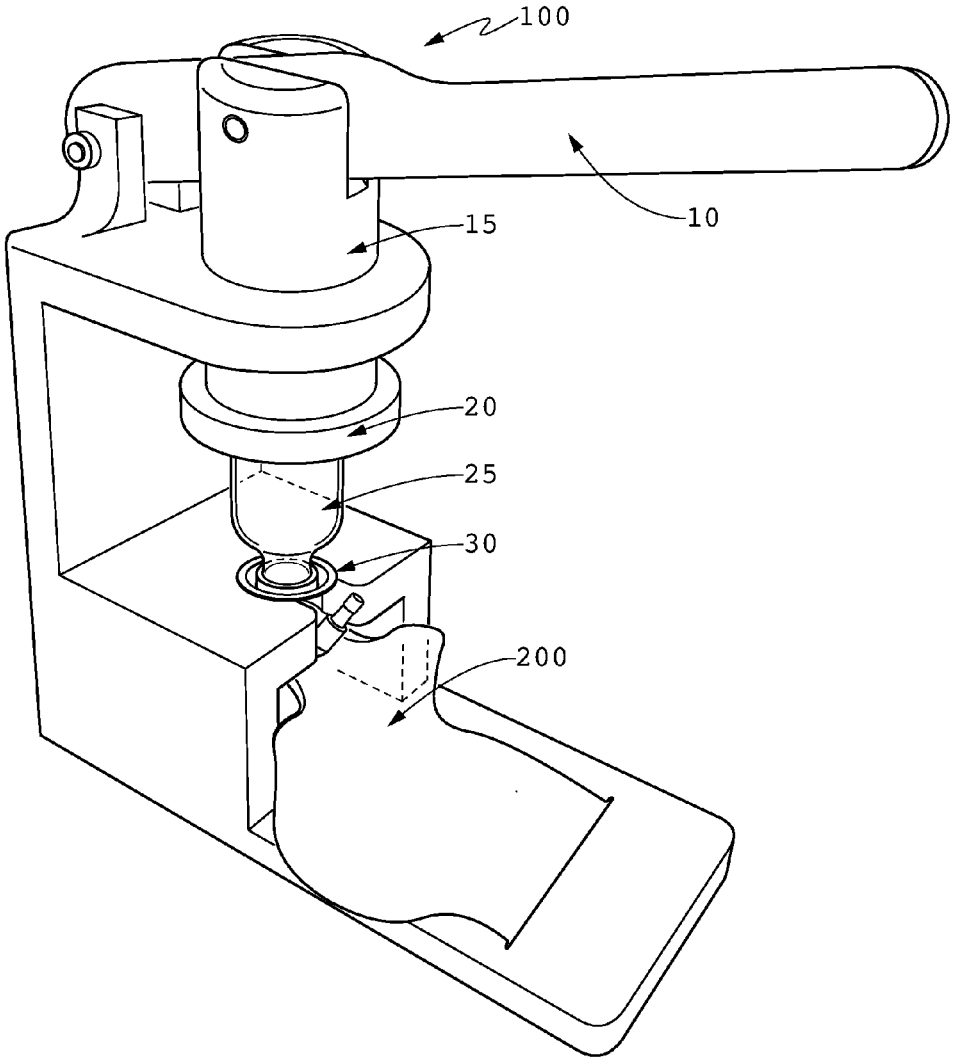
Figure 3E:
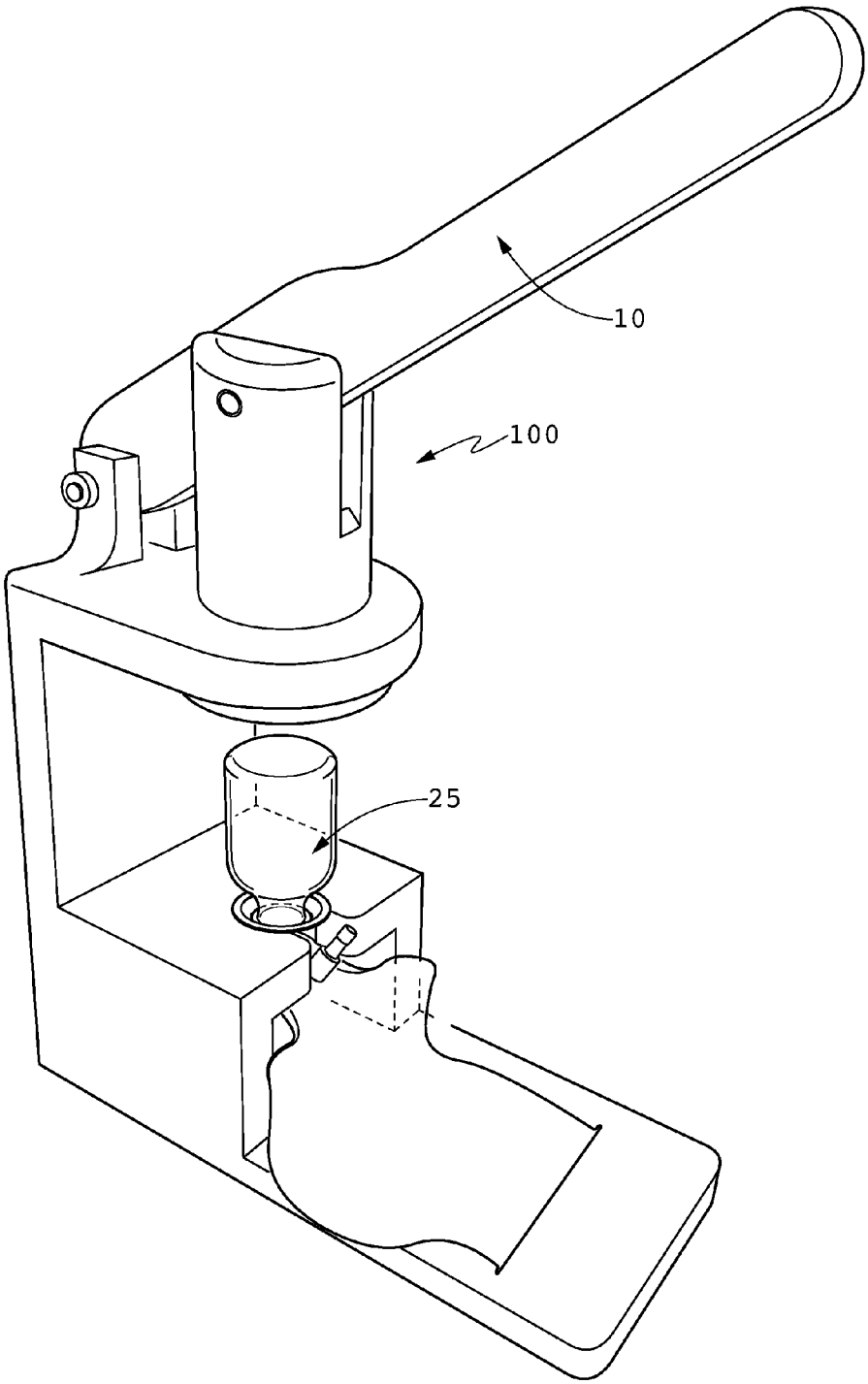
Figure 3F:
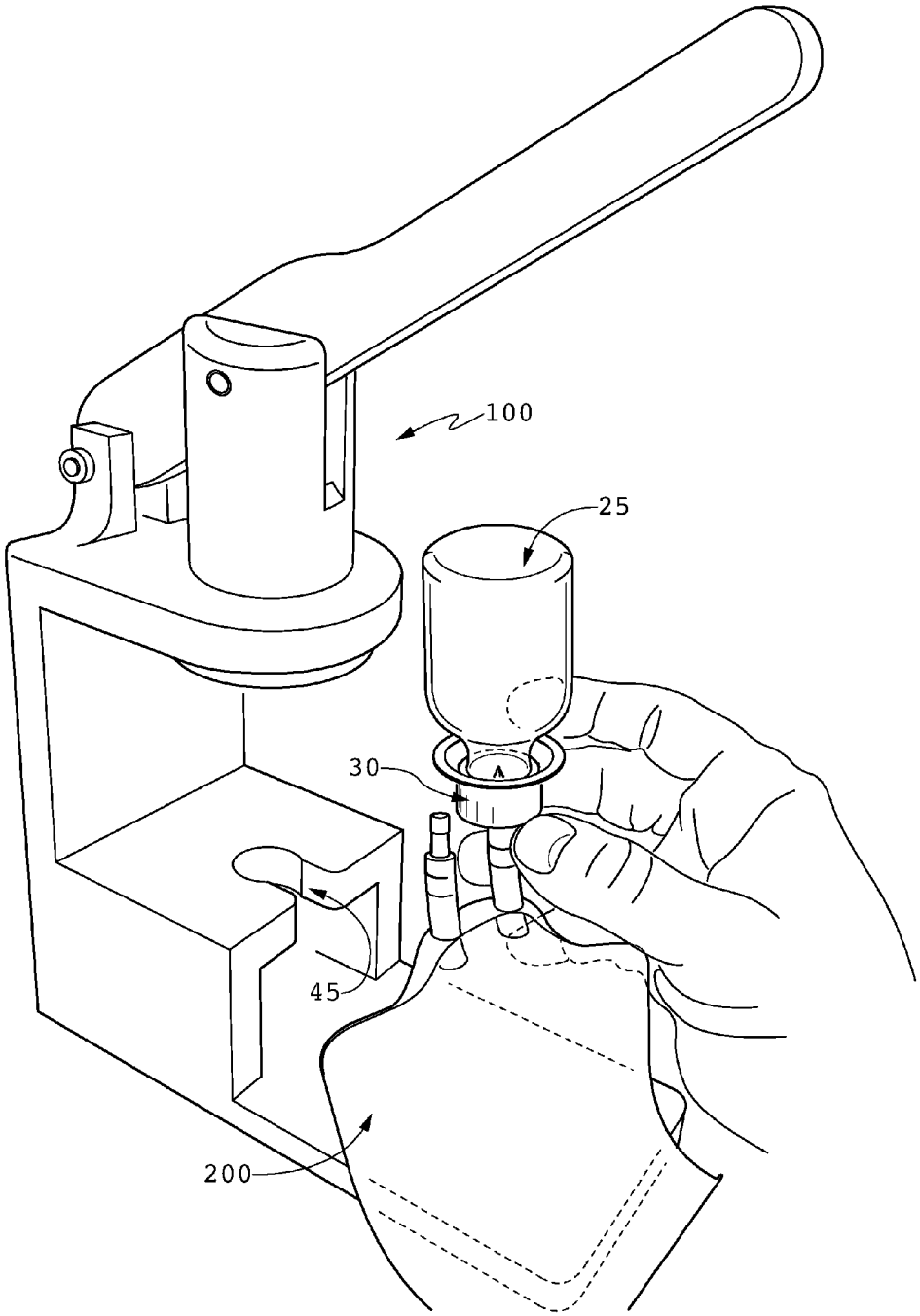

FIG. 3C is an illustration showing the vial 25 being placed within the device 100 for docking with the container 200. In this embodiment, the user may hold the vial 25 in place against the tapered portion 32 of the cap 30. FIG. 3D is an illustration showing the downward motion of the lever arm 10 and plunger 15 once the vial 25 has been captured by the collar 20. At this point, the vial 25 is preferably being pressed into the cap 30 so that the vial 25 may be docked with the container 200. In this particular embodiment, the vial 25 is preferably pierced by the cap 30 to establish fluid communication with the container 200. FIG. 3E is an illustration showing the upward motion of the lever arm 10 and plunger 15 following a successful docking procedure. FIG. 3F is an illustration showing a vial 25 that has been docked with a container 200 after removing it from the device 100. Here, the cap 30 and portions of the container 200 are permitted to exit the device 100 through the notch 45.

The device 100 can be constructed out of any number of materials, including but not limited to metals, plastics, composites, wood, or any combination of these. A preferred embodiment would be comprised primarily of plastics and an exemplary embodiment would be comprised primarily of HDPE.

Having shown and described a preferred embodiment of the invention, those skilled in the art will realize that many variations and modifications may be made to affect the described invention and still be within the scope of the claimed invention. Additionally, many of the elements indicated above may be altered or replaced by different elements which will provide the same result and fall within the spirit of the claimed invention. It is the intention, therefore, to limit the invention only as indicated by the scope of the claims.

We claim:

1. A device for docking a vial with a cap comprising:
a vertical support having front and top surfaces;
a horizontal base extending forwardly from the front surface of the vertical support;
a plate positioned above and substantially parallel to the base;
a first aperture in the plate sized to accept the cap;
a head support extending forwardly from the front surface of vertical support above the base and plate;
a lever arm hingedly fastened to the top surface of the vertical support;
a plunger adapted to slide within the head support and attached to the lever arm such that rotation of the lever arm causes the plunger to travel vertically; and
a second aperture in the plunger for accepting the vial.

2. The docking device of claim 1 further comprising:
a tapered profile in the second aperture.

3. The docking device of claim 2 wherein:
a centerline of the first aperture is substantially aligned with a centerline of the second aperture.

4. The docking device of claim 1 further comprising:
a collar attached to the plunger which limits the upward vertical movement of the plunger.

5. The docking device of claim 1 further comprising:
a notch in the plate.

6. The docking device of claim 5 wherein:
the notch is positioned opposite the vertical support.

7. The docking device of claim 1 further comprising:
a first base member extending between the base and the plate; and
a second base member extending between the base and the plate and positioned opposite the first base member.

8. The docking device of claim 7 further comprising:
a cavity defined by the space between the base, plate, vertical support, first base member, and second base member.

9. The docking device of claim 1 wherein:
the base, plate, and head support are substantially horizontal.

10. The docking device of claim 9 wherein:
the vertical support is substantially perpendicular to the base.

11. The docking device of claim 5 wherein:
the notch is sized to permit the cap to travel horizontally when removed from the device.

12. The docking device of claim 1 wherein:
the plate is adapted to provide an upward force on the cap while being docked with the vial.

13. A device for docking a vial with a cap having a ledge, piercing aperture, and an attachment means in fluid communication with a container, the device comprising:
a horizontal base having a back edge;
a vertical support having front and top surfaces;
a horizontal base extending forwardly from the front surface of the vertical support;
a plate positioned above the base and substantially parallel to the base;
a first aperture in the plate sized to accept the cap while allowing the ledge to rest atop the plate;
a head support extending horizontally from the front surface of the vertical support above the base and plate;
a lever arm hingedly fastened to the top surface the vertical support;
a plunger adapted to slide within the head support and attached to the lever arm such that rotation of the lever arm causes the plunger to travel vertically;
a tapered aperture in the plunger adapted to accept the vial; and
a notch within the plate and sized to permit the cap to travel horizontally away from the device after docking.

14. The docking device of claim 13 further comprising:
a first base member extending between the base and the plate; and
a second base member extending between the base and the plate and positioned opposite the first base member.

15. The docking device of claim 14 further comprising:
a cavity defined by the space between the base, plate, vertical support, first base member, and second base member.

16. The docking device of claim 15 wherein:
the cavity is sized to accept at least a portion of the container.

17. A method for docking a vial with a cap having a ledge and a piercing aperture, the method comprising the steps of:
presenting the device of claim 1;
positioning the cap within the first aperture such that the ledge rests atop the plate;
positioning the vial above the cap;
rotating the lever arm downward until the vial is captured between the second aperture and the cap;
rotating the lever arm downward until the piercing aperture has adequately pierced the vial;

rotating the lever arm upward until the vial is clear of the second aperture; and removing the cap and vial from the device.

18. The docking method of claim 17 wherein:

the step of removing the cap and vial from the device is performed by sliding the cap and vial horizontally out of the device.

* * * * *